US008676101B2

(12) United States Patent
Yoshikawa et al.

(10) Patent No.: US 8,676,101 B2
(45) Date of Patent: Mar. 18, 2014

(54) FIXING DEVICE HAVING METAL PIPE WITH ROUGH SECTION AND IMAGE FORMING APPARATUS INCORPORATING SAME

(75) Inventors: Masaaki Yoshikawa, Tokyo (JP); Akira Shinshi, Tokyo (JP); Yoshiki Yamaguchi, Kanagawa-ken (JP); Toshihiko Shimokawa, Kanagawa-ken (JP); Tetsuo Tokuda, Kanagawa-ken (JP); Yutaka Ikebuchi, Kanagawa-ken (JP); Naoki Iwaya, Tokyo (JP); Shuntaroh Tamaki, Kanagawa-ken (JP); Hiroshi Yoshinaga, Chiba-ken (JP); Ippei Fujimoto, Kanagawa-ken (JP); Kenji Ishii, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 552 days.

(21) Appl. No.: 12/926,661

(22) Filed: Dec. 2, 2010

(65) Prior Publication Data

US 2011/0170917 A1 Jul. 14, 2011

(30) Foreign Application Priority Data

Jan. 13, 2010 (JP) ..... 2010-004593

(51) Int. Cl.
*G03G 15/20* (2006.01)

(52) U.S. Cl.
USPC ..... 399/320; 399/329

(58) Field of Classification Search
USPC ..... 399/320, 329
See application file for complete search history.

(56) References Cited

U.S. PATENT DOCUMENTS

| | | | |
|---|---|---|---|
| 6,628,916 | B2 | 9/2003 | Yasui et al. |
| 6,636,709 | B2 | 10/2003 | Furukawa et al. |
| 6,778,790 | B2 | 8/2004 | Yoshinaga et al. |
| 6,778,804 | B2 | 8/2004 | Yoshinaga et al. |
| 6,785,505 | B2 | 8/2004 | Yasui et al. |

(Continued)

FOREIGN PATENT DOCUMENTS

| | | |
|---|---|---|
| JP | 2001-042670 | 2/2001 |
| JP | 2005-242333 | 9/2005 |

(Continued)

OTHER PUBLICATIONS

Japanese Office Action for corresponding Japanese Patent Application No. 2010-004593 dated Jul. 23, 2013.

*Primary Examiner* — David Gray
*Assistant Examiner* — Laura Roth
(74) *Attorney, Agent, or Firm* — Harness, Dickey & Pierce, P.L.C.

(57) ABSTRACT

A fixing device includes a tubular, stationary metal pipe, a flexible fuser belt, a rotatable pressure member, a fuser pad, and a lubricant. The metal pipe is subjected to heating. The flexible fuser belt is looped for rotation around the metal pipe to transfer heat radially outward from the heated metal pipe. The rotatable pressure member extends opposite the metal pipe with the fuser belt interposed between the metal pipe and the pressure member. The fuser pad is held stationary inside the loop of the fuser belt to press against the pressure member through the fuser belt to form a fixing nip. The lubricant is of a given particle size and deposited between the metal pipe and the fuser belt. The surface of the metal pipe has a rough section which exhibits a surface roughness equal to or greater than the particle size of the lubricant.

7 Claims, 4 Drawing Sheets

(56) References Cited

U.S. PATENT DOCUMENTS

| | | | | |
|---|---|---|---|---|
| 6,813,464 | B2 | 11/2004 | Amita et al. | |
| 6,881,927 | B2 | 4/2005 | Yoshinaga et al. | |
| 6,882,820 | B2 | 4/2005 | Shinshi et al. | |
| 6,892,044 | B2 | 5/2005 | Yasui et al. | |
| 6,937,827 | B2 | 8/2005 | Katoh et al. | |
| 6,947,699 | B2 * | 9/2005 | Suzuki et al. | 399/329 |
| 7,022,944 | B2 | 4/2006 | Yoshinaga et al. | |
| 7,127,204 | B2 | 10/2006 | Satoh et al. | |
| 7,151,907 | B2 | 12/2006 | Yoshinaga | |
| 7,239,838 | B2 | 7/2007 | Sato et al. | |
| 7,242,897 | B2 | 7/2007 | Satoh et al. | |
| 7,313,353 | B2 | 12/2007 | Satoh et al. | |
| 7,330,682 | B2 | 2/2008 | Shinshi | |
| 7,379,698 | B2 | 5/2008 | Yoshinaga | |
| 7,437,111 | B2 | 10/2008 | Yamada et al. | |
| 7,454,151 | B2 | 11/2008 | Satoh et al. | |
| 7,466,949 | B2 | 12/2008 | Satoh et al. | |
| 7,509,085 | B2 | 3/2009 | Yoshinaga et al. | |
| 7,546,049 | B2 | 6/2009 | Ehara et al. | |
| 7,570,910 | B2 | 8/2009 | Ishii | |
| 7,593,680 | B2 | 9/2009 | Shinshi | |
| 7,630,652 | B2 | 12/2009 | Hasegawa | |
| 7,702,271 | B2 | 4/2010 | Yamada et al. | |
| 7,742,714 | B2 | 6/2010 | Shinshi et al. | |
| 7,783,240 | B2 | 8/2010 | Ito et al. | |
| 7,796,933 | B2 | 9/2010 | Ueno et al. | |
| 7,801,457 | B2 | 9/2010 | Seo et al. | |
| 2001/0019676 | A1 * | 9/2001 | Okubo et al. | 399/329 |
| 2002/0018663 | A1 | 2/2002 | Furukawa et al. | |
| 2002/0067936 | A1 | 6/2002 | Yasui et al. | |
| 2003/0000933 | A1 | 1/2003 | Yoshinaga et al. | |
| 2003/0016963 | A1 | 1/2003 | Yoshinaga et al. | |
| 2003/0165348 | A1 | 9/2003 | Amita et al. | |
| 2003/0206758 | A1 | 11/2003 | Yasui et al. | |
| 2003/0215271 | A1 | 11/2003 | Yoshinaga et al. | |
| 2004/0013453 | A1 | 1/2004 | Shinshi et al. | |
| 2005/0025539 | A1 | 2/2005 | Yoshinaga | |
| 2005/0074251 | A1 | 4/2005 | Katoh et al. | |
| 2005/0095043 | A1 | 5/2005 | Yoshinaga et al. | |
| 2005/0147436 | A1 * | 7/2005 | Koyama et al. | 399/329 |
| 2005/0163543 | A1 | 7/2005 | Satoh et al. | |
| 2005/0180786 | A1 | 8/2005 | Yamada et al. | |
| 2006/0002737 | A1 | 1/2006 | Shinshi | |
| 2006/0029411 | A1 | 2/2006 | Ishii et al. | |
| 2006/0116230 | A1 | 6/2006 | Satoh et al. | |
| 2006/0165429 | A1 | 7/2006 | Satoh et al. | |
| 2006/0165443 | A1 | 7/2006 | Yoshinaga et al. | |
| 2006/0165448 | A1 | 7/2006 | Yoshinaga | |
| 2006/0257183 | A1 | 11/2006 | Ehara et al. | |
| 2006/0285893 | A1 | 12/2006 | Ishii | |
| 2007/0003334 | A1 | 1/2007 | Shinshi et al. | |
| 2007/0014600 | A1 | 1/2007 | Ishii et al. | |
| 2007/0014603 | A1 | 1/2007 | Satoh et al. | |
| 2007/0059003 | A1 | 3/2007 | Shinshi et al. | |
| 2007/0059071 | A1 | 3/2007 | Shinshi et al. | |
| 2007/0166085 | A1 | 7/2007 | Shinshi | |
| 2007/0292175 | A1 | 12/2007 | Shinshi | |
| 2008/0063443 | A1 | 3/2008 | Yoshinaga et al. | |
| 2008/0112739 | A1 | 5/2008 | Shinshi | |
| 2008/0175633 | A1 | 7/2008 | Shinshi | |
| 2008/0187372 | A1 * | 8/2008 | Kato | |
| 2008/0219721 | A1 | 9/2008 | Ito et al. | |
| 2008/0219730 | A1 | 9/2008 | Shinshi | |
| 2008/0226326 | A1 | 9/2008 | Seo et al. | |
| 2008/0232873 | A1 | 9/2008 | Ueno et al. | |
| 2008/0253788 | A1 | 10/2008 | Shinshi | |
| 2008/0253789 | A1 | 10/2008 | Yoshinaga et al. | |
| 2008/0298862 | A1 | 12/2008 | Shinshi | |
| 2008/0317532 | A1 | 12/2008 | Ehara et al. | |
| 2009/0003867 | A1 | 1/2009 | Fujimoto | |
| 2009/0010687 | A1 | 1/2009 | Yamada et al. | |
| 2009/0067902 | A1 | 3/2009 | Yoshinaga et al. | |
| 2009/0123201 | A1 | 5/2009 | Ehara et al. | |
| 2009/0123202 | A1 | 5/2009 | Yoshinaga et al. | |
| 2009/0148204 | A1 | 6/2009 | Yoshinaga et al. | |
| 2009/0169232 | A1 | 7/2009 | Kunii et al. | |
| 2009/0245865 | A1 | 10/2009 | Shinshi et al. | |
| 2009/0311016 | A1 | 12/2009 | Shinshi | |
| 2010/0074667 | A1 | 3/2010 | Ehara et al. | |
| 2010/0092220 | A1 | 4/2010 | Hasegawa et al. | |
| 2010/0092221 | A1 | 4/2010 | Shinshi et al. | |
| 2010/0202809 | A1 | 8/2010 | Shinshi et al. | |
| 2010/0290822 | A1 | 11/2010 | Hasegawa et al. | |
| 2011/0052282 | A1 * | 3/2011 | Shinshi et al. | 399/329 |
| 2011/0222931 | A1 * | 9/2011 | Shinshi et al. | 399/329 |

FOREIGN PATENT DOCUMENTS

| | | |
|---|---|---|
| JP | 2007-052229 | 3/2007 |
| JP | 2007-334205 | 12/2007 |
| JP | 2008-146964 | 6/2008 |
| JP | 2008-158482 | 7/2008 |
| JP | 2009-003410 | 10/2009 |
| JP | 2011-076060 | 4/2011 |

* cited by examiner

FIXING DEVICE HAVING METAL PIPE WITH ROUGH SECTION AND IMAGE FORMING APPARATUS INCORPORATING SAME

CROSS-REFERENCE TO RELATED APPLICATIONS

The present patent application claims priority pursuant to 35 U.S.C. §119 from Japanese Patent Application No. 2010-004593, filed on Jan. 13, 2010, which is hereby incorporated by reference herein in its entirety.

BACKGROUND OF THE INVENTION

1. Field of the Invention

The present invention relates to a fixing device and an image forming apparatus incorporating the same, and more particularly, to a fixing device that fixes a toner image in place on a recording medium with heat and pressure, and an electrophotographic image forming apparatus, such as a photocopier, facsimile machine, printer, plotter, or multifunctional machine incorporating several of those imaging functions, incorporating such a fixing device.

2. Description of the Background Art

In electrophotographic image forming apparatus, such as photocopiers, facsimiles, printers, plotters, or multifunctional machines incorporating several of those imaging functions, an image is formed by attracting toner particles to a photoconductive surface for subsequent transfer to a recording medium such as a sheet of paper. After transfer, the imaging process is followed by a fixing process using a fixing device, which permanently fixes the toner image in place on the recording medium by melting and settling the toner with heat and pressure.

Various types of fixing devices are known in the art, most of which employ a pair of generally cylindrical, looped belts or rollers, one being heated for fusing toner ("fuser member") and the other being pressed against the heated one ("pressure member"), which together form a heated area of contact called a fixing nip through which a recording medium is passed to fix a toner image under heat and pressure.

One conventional type of fuser assembly employed in the fixing device is an endless belt looped for rotation around a generally cylindrical, stationary metal pipe, typically formed by bending a thin sheet of conductive metal into a rolled configuration, which has its outer circumference entirely or partially facing the inner surface of the looped fuser belt. The metal pipe has its circumference subjected to heating, for example, by radiation, from which heat is radially transferred to the length of the fuser belt rotating around the metal pipe.

Using the combination of a looped belt and a thin-walled metal pipe, the fuser assembly allows for heating the fixing nip swiftly and uniformly, resulting in shorter periods of warm-up time and first-print time required to complete an initial print job upon startup. This type of fixing device therefore has high immunity against printing failures caused by insufficient heating of the fixing nip in high-speed applications.

One problem encountered in a fuser assembly formed of a combination of cylindrical members (e.g., an endless looped belt and a metal pipe) is its vulnerability to wear where the cylindrical members, one rotatable around the other held substantially stationary, come into repeated frictional contact with each other so that the contacting surfaces chafe and abrade during operation. To prevent such wear, a common practice is to provide a lubricant to reduce frictional resistance between the two contacting surfaces.

For example, one conventional fixing device employs a cylindrical fixing sleeve which is subjected to induction heating while rotatably held around a cylindrical fixing roller to form a fuser assembly. The fixing roller has an outer circumference thereof formed of foamed material impregnated with a lubricant. The lubricant thus provided between the fixing sleeve and the fixing roller, the former rotatable around the latter, serves to reduce friction between the cylindrical surfaces during operation.

Although generally successful for its intended purposes, the provision of lubricant does not have a durable, long-lasting effect when applied to the fuser assembly formed of an endless looped belt and a metal pipe described above. This is because the lubricant tends to be squeezed out or flow away from the area of contact over the circumferential surface of the metal pipe. Such displacement of lubricant results in a loss of lubrication and high frictional resistance at the belt/pipe interface, which, over time, leads to damage and other concomitant failures of the fixing device.

SUMMARY OF THE INVENTION

Exemplary aspects of the present invention are put forward in view of the above-described circumstances, and provide a novel fixing device that fixes a toner image in place on a recording medium.

In one exemplary embodiment, the novel fixing device includes a tubular, stationary metal pipe, a flexible fuser belt, a rotatable pressure member, a fuser pad, and a lubricant. The metal pipe is subjected to heating. The flexible fuser belt is looped for rotation around the metal pipe to transfer heat radially outward from the heated metal pipe. The rotatable pressure member extends opposite the metal pipe with the fuser belt interposed between the metal pipe and the pressure member. The fuser pad is held stationary inside the loop of the fuser belt to press against the pressure member through the fuser belt to form a fixing nip through which a recording medium is passed to fix a toner image thereupon under heat and pressure. The lubricant is of a given particle size and deposited between the metal pipe and the fuser belt. The surface of the metal pipe has a rough section which exhibits a surface roughness equal to or greater than the particle size of the lubricant.

Other exemplary aspects of the present invention are put forward in view of the above-described circumstances, and provide a novel image forming apparatus.

In one exemplary embodiment, the image forming apparatus includes an electrophotographic imaging unit and the fixing device described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
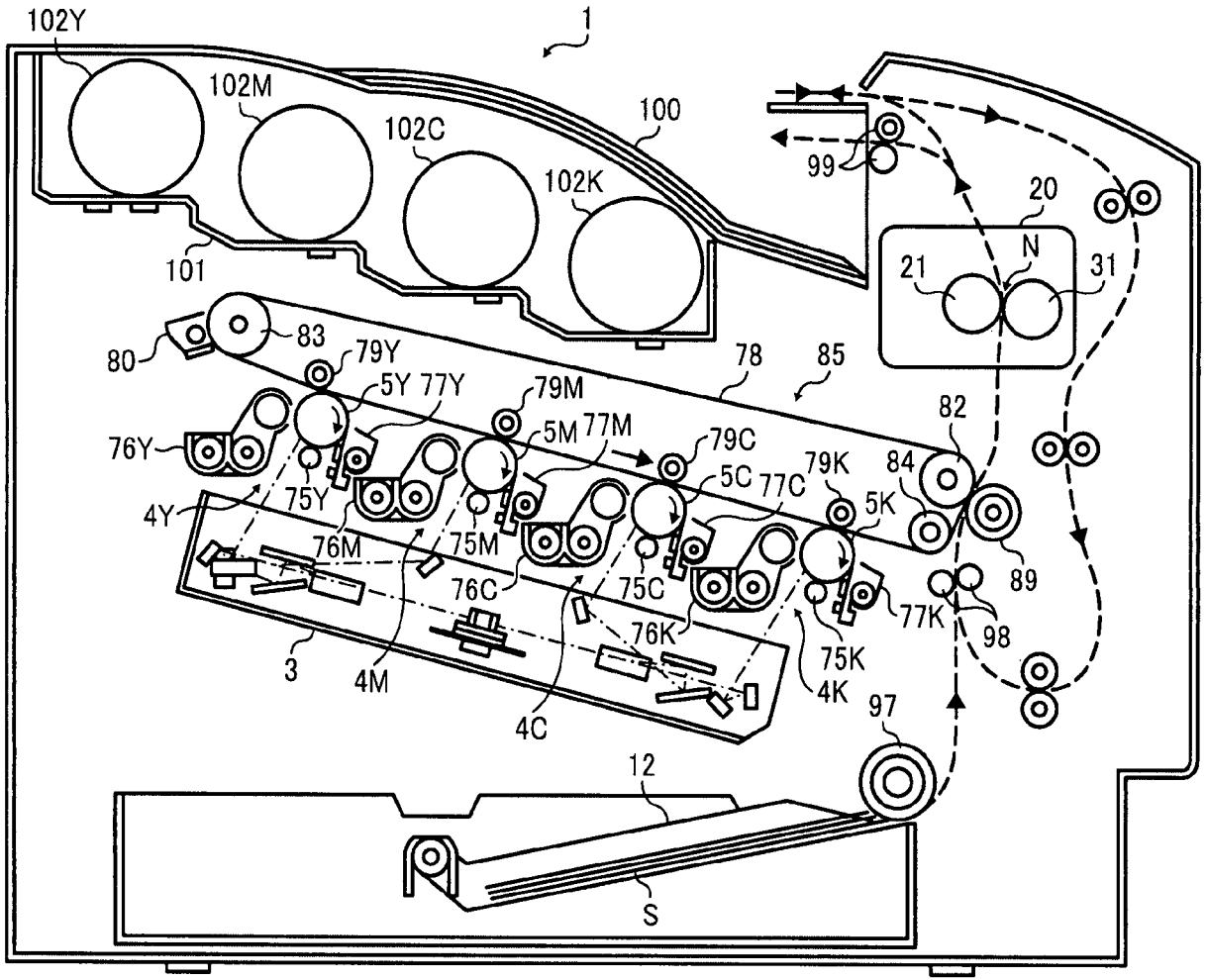
FIG. 1 schematically illustrates an image forming apparatus incorporating a fixing device according to one embodiment of this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 1 incorporating a fixing device 20 according to one embodiment of this patent specification.

As shown in FIG. 1, the image forming apparatus 1 is a tandem color printer including four imaging stations 4Y, 4M, 4C, and 4K arranged in series along the length of an intermediate transfer unit 85 and adjacent to a write scanner 3, which together form an electrophotographic mechanism to form an image with toner particles on a recording medium such as a sheet of paper S, for subsequent processing through the fixing device 20 located above the intermediate transfer unit 85. The image forming apparatus 1 also includes a feed roller 97, a pair of registration rollers 98, a pair of discharge rollers 99, and other conveyor and guide members together defining a sheet conveyance path, indicated by broken lines in the drawing, along which a recording sheet S advances upward from a bottom sheet tray 12 accommodating a stack of recording sheets toward the intermediate transfer unit 85 and then through the fixing device 20 to finally reach an output tray 100 situated atop the apparatus body.

In the image forming apparatus 1, each imaging unit (indicated collectively by the reference numeral 4) has a drum-shaped photoconductor 5 surrounded by a charging device 75, a development device 76, a cleaning device 77, a discharging device, not shown, etc., which work in cooperation to form a toner image of a particular primary color, as designated by the suffixes "Y" for yellow, "M" for magenta, "C" for cyan, and "K" for black. The imaging units 4Y, 4M, 4C, and 4K are supplied with toner from replaceable toner bottles 102Y, 102M, 102C, and 102K, respectively, accommodated in a toner supply 101 in the upper portion of the apparatus 1.

The intermediate transfer unit 85 includes an intermediate transfer belt 78, four primary transfer rollers 79Y, 79M, 79C, and 79K, a secondary transfer roller 89, and a belt cleaner 80, as well as a transfer backup roller or drive roller 82, a cleaning backup roller 83, and a tension roller 84 around which the intermediate transfer belt 78 is entrained. When driven by the roller 82, the intermediate transfer belt 78 travels counterclockwise in the drawing along an endless travel path, passing through four primary transfer nips defined between the primary transfer rollers 79 and the corresponding photoconductive drums 5, as well as a secondary transfer nip defined between the transfer backup roller 82 and the secondary transfer roller 89.

The fixing device 20 includes a fuser member 21 and a pressure member 31, one being heated and the other being pressed against the heated one, to form an area of contact or a "fixing nip" N therebetween in the sheet conveyance path. A detailed description of the fixing device 20 will be given later with reference to FIG. 5 and subsequent drawings.

During operation, each imaging unit 4 rotates the photoconductor drum 5 clockwise in the drawing to forward its outer, photoconductive surface to a series of electrophotographic processes, including charging, exposure, development, transfer, and cleaning, in one rotation of the photoconductor drum 5.

First, the photoconductive surface is uniformly charged by the charging device 75 and subsequently exposed to a modulated laser beam emitted from the write scanner 3. The laser exposure selectively dissipates the charge on the photoconductive surface to form an electrostatic latent image thereon according to image data representing a particular primary color. Then, the latent image enters the development device which renders the incoming image visible using toner. The toner image thus obtained is forwarded to the primary transfer nip between the intermediate transfer belt 78 and the primary transfer roller 79.

At the primary transfer nip, the primary transfer roller 79 applies a bias voltage of a polarity opposite that of the toner to the intermediate transfer belt 78. This electrostatically transfers the toner image from the photoconductive surface to an outer surface of the belt 78, with a certain small amount of residual toner particles left on the photoconductive surface. Such transfer process occurs sequentially at the four transfer nips along the belt travel path, so that toner images of different colors are superimposed one atop another to form a single multicolor image on the surface of the intermediate transfer belt 78.

After primary transfer, the photoconductive surface enters the cleaning device 77 to remove residual toner by scraping it off with a cleaning blade, and then to the discharging device to remove residual charges for completion of one imaging cycle. At the same time, the intermediate transfer belt 78 forwards the multicolor image to the secondary transfer nip between the transfer backup roller 82 and the secondary transfer roller 89.

Meanwhile, in the sheet conveyance path, the feed roller 97 rotates counterclockwise in the drawing to introduce a recording sheet S from the sheet tray 12 toward the pair of registration rollers 98 being rotated. Upon receiving the fed sheet S, the registration rollers 98 stop rotation to hold the incoming sheet S therebetween, and then advance it in sync with the movement of the intermediate transfer belt 78 to the secondary transfer nip. At the secondary transfer nip, the multicolor image is transferred from the belt 78 to the recording sheet S, with a certain small amount of residual toner particles left on the belt surface.

After secondary transfer, the intermediate transfer belt 78 enters the belt cleaner 80, which removes and collects residual toner from the intermediate transfer belt 78. At the same time, the recording sheet S bearing the powder toner image thereon is introduced into the fixing device 20, which fixes the multicolor image in place on the recording sheet S with heat and pressure through the fixing nip N.

Thereafter, the recording sheet S is ejected by the discharge rollers 99 to the output tray 100 for stacking outside the apparatus body, which completes one operational cycle of the image forming apparatus 1.

Figure 2:
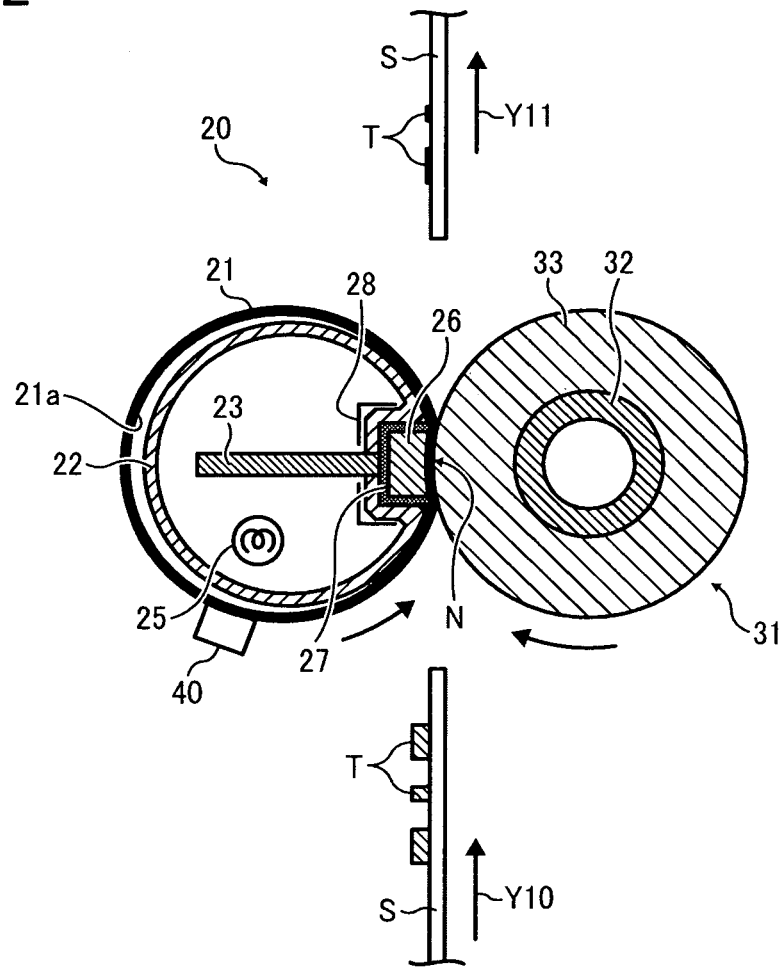
FIG. 2 is an end-on, axial cutaway view schematically illustrating one example of the fixing device incorporated in the image forming apparatus of FIG. 1.
Figure 3:
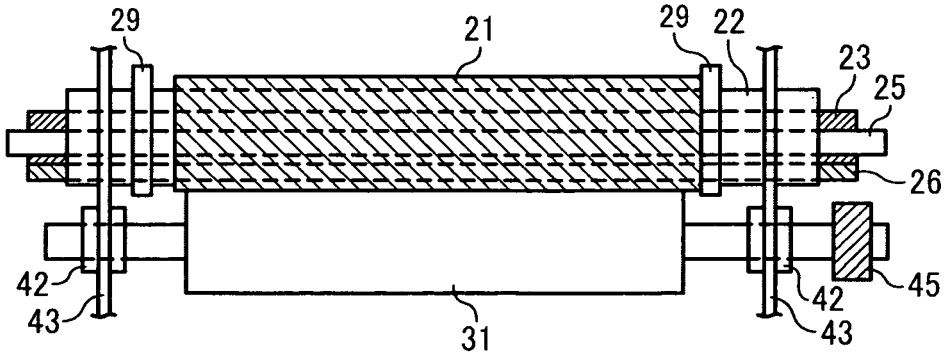
FIG. 3 is a transverse view schematically illustrating the fixing device of FIG. 2.

FIGS. 2 and 3 are end-on, axial cutaway and transverse views, respectively, schematically illustrating the fixing device 20 incorporated in the image forming apparatus 1 according to this patent specification.

As shown in FIGS. 2 and 3, the fixing device 20 includes a rotatable fuser belt 21 looped into a generally cylindrical configuration for rotation around a generally cylindrical, stationary metal pipe 22, and a rotatable, generally cylindrical pressure roller 31 held in pressure contact with an outer surface of the fuser belt 21, which extend parallel to each other along an axial, longitudinal direction between a pair of sidewalls 43 of the fixing device 20. Although not specifically shown in FIGS. 2 and 3 but shown in FIG. 4, a lubricant L is provided between the fuser belt 21 and the metal pipe 22 to reduce friction therebetween during rotation of the fuser belt 21.

Specifically, the pressure roller 31 has two ends rotatably held at the sidewalls 43 via a pair of bearings 42. Outside the sidewalls 43, the pressure roller 31 is connected to a drive motor, not shown, via a set of one or more gears 45 for imparting torque from the drive motor to the roller 31 clockwise in FIG. 2.

Inside the loop of the fuser belt 21 is a fuser pad 26 extending in the longitudinal direction facing the pressure roller 31, held stationary with its two longitudinal ends fixed to the sidewalls 43. The fuser pad 26 is pressed against the pressure roller 31 through the fuser belt 21 to define a fixing nip N therebetween, where it establishes sliding contact with an inner surface 21*a* of the rotating belt 21.

The metal pipe 22 accommodates the fuser pad 26 in a side slot defined in one side thereof, so that the metal pipe 22 faces the inner surface 21*a* of the looped belt 21 except where the fuser pad 26 forms the fixing nip N. The metal pipe 22 has its two ends fixed to the sidewalls 43 and is provided with a pair of annular flanges 29 fitted therearound to prevent the belt 21 from displacing in the longitudinal direction.

Disposed within the metal pipe 22 is a reinforcing member 23 extending in the longitudinal direction, held stationary with its two longitudinal ends fixed to the sidewalls 43 to reinforce the metal pipe 22 from inside and around the side slot within which the fuser pad 26 is accommodated. Also disposed within the metal pipe 22 is a radiant heater 25 to irradiate the metal pipe 22, held stationary with its two longitudinal ends fixed to the sidewalls 43. An insulating member 27 is provided to thermally insulate the fuser pad 26 from radiation by the heater 25. A thermometer 40 is disposed adjacent to the surface of the fuser belt 21 to detect temperature of the belt surface for controlling operation of the heater 25.

During operation, the fixing device 20 activates the roller drive motor and the heater 25 as the image forming apparatus 1 is powered up. Upon activation, the heater 25 starts heating the metal pipe 22 by radiation, which in turn heats the fuser belt 21 to a predetermined processing temperature by conduction. At the same time, the motor-driven pressure roller 31 starts rotation in frictional contact with the fuser belt 21, which in turn rotates around the metal pipe 22 counterclockwise in FIG. 2.

Then, a recording sheet S with an unfixed, powder toner image T formed thereon enters the fixing device 20 with its printed side brought into contact with the fuser belt 21 and the other side with the pressure roller 31. Upon reaching the fixing nip N, the recording sheet S moves along the rotating surfaces of the belt 21 and the roller 31 in the direction of arrow Y10 perpendicular to the axial direction, substantially flat and erect along surfaces of guide plates, not shown, disposed along the sheet conveyance path.

At the fixing nip N, the fuser belt 21 heats the incoming sheet S to fuse and melt the toner particles T, while the pressure roller 31 presses the sheet S against the fuser pad 26 held stationary by the reinforcing member 23 to cause the molten toner T to settle onto the sheet surface. As the toner image T is thus fixed in place through the fixing nip N, the recording sheet S is forwarded to exit the fixing device 20 in the direction of arrow Y11.

In the present embodiment, the pressure roller 31 comprises a cylindrical rotatable body approximately 30 mm in diameter, formed of a hollow, cylindrical metal core 32 covered with an outer layer 33 of elastic material, such as foamed or solid silicone rubber, fluorine rubber, or the like, and optionally, with an additional coating of a release agent, such as perfluoroalkoxy (PFA), polytetrafluoroethylene (PTFE), or the like, deposited on the elastic layer 33. Further, the pressure roller 31 may have a heating element, such as a halogen heater, within the interior of the hollow roller core 32.

Forming the roller outer layer 33 with sponge material is advantageous, since it prevents excessive nip pressure, which would otherwise cause the metal pipe 22 to substantially bend away from the pressure roller 31 at the fixing nip N. Another advantage is that it provides favorable thermal insulation at the fixing nip N to prevent heat transfer from the fuser belt 21 to the pressure roller 31, leading to enhanced heating efficiency in the fixing device 20.

It should be noted that although the fuser belt 21 and the pressure roller 31 are of a substantially identical diameter in the embodiment depicted in FIGS. 2 and 3, instead, it is possible to provide the cylindrical fixing members 21 and 31 with different diameters, in particular, the fuser belt 21 with a relatively small diameter and the pressure roller 31 with a relatively large diameter. Forming the fuser belt 21 with a diameter smaller than that of the pressure roller 31 gives a greater curvature to the fuser belt 21 than that of the pressure roller 31 at the fixing nip N, which effects good stripping of a recording sheet from the fuser belt 21 upon exiting the fixing nip N.

The fuser belt 21 comprises a thin, multi-layered, looped flexible belt approximately 1 mm or less in thickness and approximately 15 to 120 mm in diameter in its generally cylindrical looped shape (with an inner diameter of about 30 mm in the present embodiment), the overall length of which is formed of a substrate covered with an intermediate elastic layer and an outer release coating deposited thereon, one atop another.

Specifically, the belt substrate may be a layer of metal or resin, such as nickel, stainless steel, polyimide, or the like, approximately 30 to 50 μm in thickness. The intermediate elastic layer may be a deposit of rubber, such as solid or foamed silicone rubber, fluorine resin, or the like, approximately 100 to 300 μm in thickness. The outer coating may be a deposit of a release agent, such as tetra fluoro ethylene-perfluoro alkylvinyl ether copolymer or PFA, PTFE, polyimide (PI), polyetherimide (PEI), polyethersulfide (PES), or the like, approximately 10 to 50 μm in thickness.

The intermediate elastic layer serves to accommodate minute variations in applied pressure to maintain smoothness of the belt surface at the fixing nip N, which ensures uniform distribution of heat across a recording sheet S to yield a resulting image with a smooth, consistent appearance. Further, the release coating layer provides good stripping of toner from the belt surface to ensure reliable conveyance of recording sheets S through the fixing nip N.

Inside the loop of the fuser belt 21, various fixing members are disposed stationary, (i.e., fixed in position, and do not rotate as the fuser belt 21 rotates), including the metal pipe 22, the reinforcing member 23, the heater 25, the fuser pad 26, the heat insulating member 27, and the shape retention stay 28.

Figure 4:
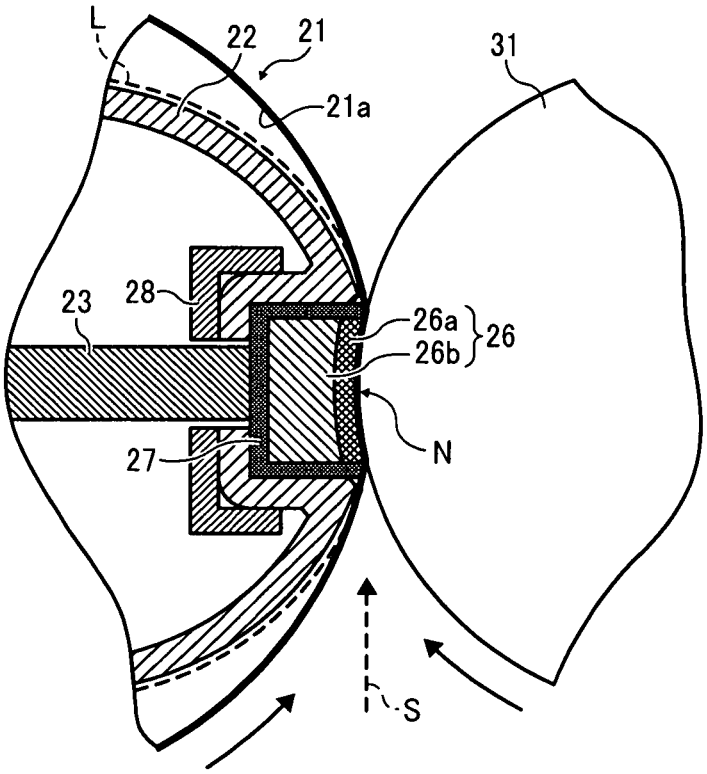
FIG. 4 is an enlarged, end-on, axial cutaway view illustrating the fixing device of FIG. 2.

The fixing device 20 is shown with details of such stationary fixing members with additional reference to FIG. 4.

The metal pipe 22 comprises a generally cylindrical, thin-walled tubular member formed by bending a thin sheet of thermally conductive material into a rolled configuration, which in the present embodiment has an open-concave side formed by spacing a pair of opposed ends of the rolled sheet from each other and then turning the ends inward to define a side slot extending in the longitudinal direction. Although the present embodiment depicts the metal pipe 22 as a generally cylindrical member, alternatively, the metal pipe 22 may have its tubular body formed in various configurations, including cylinders, prisms, and composite shapes.

The metal pipe 22 accommodates the fuser pad 26 in its side slot in contact with the reinforcing member 23, with the heat insulating member 27 disposed between adjoining walls of the pipe 22 and the pad 26 for thermally insulating the pad 26 from radiation by the heater 25. With such side slot, the metal pipe 22 faces the inner surface 21*a* of the fuser belt 22 except at the fixing nip N defined by the fuser pad 26 pressing against the pressure roller 31.

The metal pipe 22 may be made of a thermally conductive material with a thickness not exceeding 0.2 mm, preferably, not exceeding 0.1 mm. Forming the metal pipe 22 with a wall thickness not exceeding 0.2 mm is desirable for promptly heating the roll circumference to a predetermined processing temperature during operation, which leads to reduced warm-up time and high thermal efficiency of the fixing device 20. Examples of suitable conductive material include metals, such as stainless steel, nickel, aluminum, and iron, of which ferritic stainless steel is preferable due to its relatively low volumetric heat capacity (i.e., specific heat capacity multiplied by density) leading to high thermal efficiency of the fixing device 20. For example, the metal pipe 22 may be formed of a commercially available ferritic stainless steel, SUS430, approximately 0.1 mm thick, which may be readily obtained through suitable metalworking processes.

Preferably, there is a gap or clearance δ not exceeding 1 mm between the inner circumference of the fuser belt 21 and the outer circumference of the metal pipe 22 except at the fixing nip N. Maintaining the gap δ between the fuser belt 21 and the metal pipe 22 prevents the elastic belt surface from premature wear caused by excessive rubbing against the metal pipe surface. Moreover, holding the belt-to-pipe gap δ within an adequate range ensures efficient heat transfer from the metal pipe 22 to the fuser belt 21, which prevents failures caused by insufficient heating at the fixing nip N, and also maintains the flexible belt 21 in a generally cylindrical configuration around the metal pipe 22 for preventing deformation and concomitant deterioration and breakage.

With specific reference to FIG. 4, the metal pipe 22 is shown with the lubricant L disposed between the adjoining surfaces of the metal pipe 22 and the fuser belt 21. The lubricant L reduces friction at the interface to prevent the fuser belt 21 from chafing and abrasion even when operated in sliding contact with the metal pipe 22. Such lubricant L includes any suitable lubricating agent known in the art, such as fluorine grease and silicone oil, which may contain particulate material of a given particle size. Although FIG. 4 shows the lubricant L deposited on the metal pipe 22, the lubricant L may be provided to either or both of the fuser belt 21 and the metal pipe 22 upon installation of the fixing device 20.

According to this patent specification, the metal pipe 22 has its outer circumference at least partially roughened to effectively retain the lubricant L in position around the metal pipe 22. Such special configuration of the metal pipe 22 allows the fuser assembly to operate properly with durable, long-lasting lubrication over an extended period of use. A detailed description of the metal pipe configuration will be provided later with reference to FIG. 5.

With continued reference to FIGS. 2 through 4, the heater 25 comprises a radiation heating element, such as a halogen heater or carbon heater, supplied with a regulated power supply included in the image forming apparatus 1. The thermometer 40 comprises a thermistor or other suitable temperature sensor, located facing the surface of the fuser belt 21 to sense the temperature of the belt surface. The power supply of the heater 25 is controlled according to readings of the thermometer 40 to maintain the fuser belt 21 at a desired processing temperature.

Specifically, to warm up the fixing device 20, the radiation heater 25 heats the metal pipe 22 directly through radiation, and the fuser belt 21 indirectly through conduction from the metal pipe 22 being heated. That is, the heater 25 irradiates the inner circumference of the metal pipe 22, which then conducts heat to those portions of the fuser belt 21 in contact with the roller circumference (i.e., outside the fixing nip N). As the fuser belt 21 rotates, this results in uniformly heating the entire length of the rotating belt 21 sufficiently for fusing toner at the fusing nip N.

Thus, the fuser belt 21 has its length heated substantially continuously and uniformly by conduction from the outer circumference of the metal pipe 22 being internally heated by irradiation with the heater 25. Compared to directly and locally heating portions of a fuser member, such indirect continuous heating can warm up the entire length of the fuser belt 21 swiftly and efficiently with a relatively simple configuration, which allows the fixing device 20 to operate at higher processing speeds without causing image defects due to premature entry of recording sheets into the fixing nip N. This leads to a reduction in warm-up time and first-print time required for completing an initial print job upon startup, while maintaining a compact size of the image forming apparatus 1 incorporating the fixing device 20.

With specific reference to FIG. 4, the fuser pad 26 is shown consisting of a rigid base 26*b* covered with a surface layer 26*a* of suitable material to define an outer, contact surface facing the pressure roller 31. The contact surface of the fuser pad 26, which establishes sliding contact with the pressure roller 31 through the fuser belt 21 during operation, is available in various configurations according to particular applications of the fixing device 20.

For example, the fuser pad 26 may have a slightly concave contact surface with a curvature similar to that of the circumference of the pressure roller 31, as in the embodiment depicted in FIG. 4. The concave contact surface allows a recording sheet S to conform to the curvature of the pressure roller 31 during passage through the fixing nip N, which ensures reliable conveyance of the sheet S without adhering to and wrapping around the fuser belt 21 upon exiting the fixing nip N.

Alternatively, instead of the concave configuration, the fuser pad 26 may have a substantially flat contact surface. The flat contact surface causes a recording sheet S to remain straight and hence intimately contact the fuser belt 21 within the fixing nip N, resulting in efficient fusing performance, while allowing for good stripping of the recording sheet S from the fuser belt 21, which exhibits a curvature larger at the exit of the fixing nip N than within the fixing nip N.

Provision of the fuser pad 26 can protect the metal pipe 22 from deformation under nip pressure, where the fuser pad 26 is disposed in the side slot of the metal pipe 22 to form the fixing nip N subjected to pressure from the pressure roller 31.

Having the open side defining the side slot to accommodate the separate fuser pad 26 facing the pressure roller 31, the metal pipe 22 can operate substantially in isolation from the pressure roller 31, and thus prevented from bending or bowing away from the fixing nip N under pressure applied by the pressure roller 31.

Such capability to protect the metal pipe 22 against deformation under nip pressure is particularly effective in a configuration where, as in the present embodiment, the metal pipe 22 is extremely thin-walled, with its wall thickness approximately 0.2 mm or less, and therefore is low in strength, for obtaining high thermal efficiency in heating the fuser belt 21. Protection against pipe deformation in turn protects the fuser belt 21 against damage and failure, such as slipping off the metal pipe or inconsistent heating due to non-uniform contact between the fuser belt and the metal pipe, resulting in proper operation of the fixing device 20 according to this patent specification.

In the present embodiment, the surface layer 26*a* of the fuser pad 26 comprises a low-friction sheet of coarse textured material impregnated with a lubricant before installation. With the surface layer 26*a* thus retaining lubricant, the fuser pad 26 remains lubricated over an extended period of use so as to prevent the surfaces of the belt 21 and the pad 26 from chafing and abrasion in sliding contact with each other.

The rigid base 26*b* of the fuser pad 26 may be formed of sufficiently stiff material, such as rigid metal or ceramic. The rigid base 26*b* allows the fuser pad 26 to securely form the fixing nip N without bending or bowing away from the fixing nip N under pressure from the pressure roller 31.

The reinforcing member 23 comprises an elongated piece of rigid material with its length substantially equal to that of the fuser pad 26. In the present embodiment, the reinforcing member 23 extends across a width of the generally cylindrical cross-section of the metal pipe 22 to divide the roller interior generally into two compartments. The reinforcing member 23 serves to strengthen and support the fuser pad 26 in position subjected to pressure from the pressure roller 31 in the fixing nip N. That is, the reinforcing member 23 thrusts the fuser pad 26 against the pressure roller 31 through the fuser belt 21, so that the fuser pad 26 does not substantially displace or deform under nip pressure.

Preferably, the reinforcing member 23 is formed of metal, such as stainless steel or iron, which exhibits sufficient stiffness to support the fuser pad 26 in proper position and shape. Further, the reinforcing member 23 may have its rear side (i.e., the side that faces the heater 25 upon installation in the hollow interior of the metal pipe 22) partially or entirely provided with thermal insulation, or subjected to a bright annealing or mirror polish during manufacture. Such surface treatment enables the reinforcing member 23 to repel or reflect radiation from the heater 25, which allows the metal pipe 22 to efficiently absorb heat generated by the heater 25 for transfer to the fuser belt 21, leading to enhanced heating efficiency in the fixing device 20.

The heat insulating member 27 comprises a layer of thermally insulative material, such as sponge rubber and porous ceramic, that covers those surfaces of the fuser pad 26 facing the metal pipe 22, i.e., except for the sliding contact surface facing the inner surface 21*a* of the fuser belt 21.

Thermally insulating the fuser pad 26 prevents the pressure roller 31 from damage or deformation due to intense heating even where the fixing device 20 is "on-demand", i.e., capable of promptly executing an incoming print job after warm-up, in which the fuser belt 21 has almost its entire length retained adjacent to the surface of the heated metal pipe 22 for uniformly heating even while idle (i.e., when the fixing device 20 waits for a print job).

In a conventional on-demand fuser configuration that intensively heats a pressure roller compressed under pressure at a fixing nip during warm-up, the pressure roller can develop thermal degradation or permanent compressive deformation depending on the elastic material used. Thermal degradation results in a reduced lifetime of the pressure roller. On the other hand, permanent compressive deformation translates into a locally concave surface of the pressure roller, which may result in defective performance of the fixing device, such as imperfections in prints and/or abnormal noise during rotation of the fixing roller, due to variations in width and intensity of the fixing nip formed by the concave roller surface.

Providing the heat insulating member 27 protects the fixing device 20 against those problems associated with thermal damage of the pressure roller, wherein the heat insulating member 27 prevents heat transfer from the metal pipe 22 to the fuser pad 26, which eventually prevents the elastic pressure roller 31 from intense heating at the fixing nip N where the pressure roller 31 is compressed under nip pressure.

Further, provision of the heat insulating member 27 prevents thermal degradation of the lubricant disposed at the interface between the fuser pad 26 and the fuser belt 21. The lubricating agent disposed can deteriorate as a result of high pressure combined with high temperature at the fixing nip, which translates into defective operation of the fixing device, such as the fuser belt slipping off the metal pipe. The heat insulating member 27, preventing heat transfer from the metal pipe 22 to the fuser pad 26, protects the lubricant from intense heating, thereby preventing problems associated with thermal degradation of the lubricant at the fixing nip N.

Moreover, provision of the heat insulating member 27 ensures proper sheet conveyance through the fixing nip N. With the heat insulating member 27 thermally isolating the fuser pad 26, the fuser belt 21 remains unheated at the fixing nip N relative to other portions along the circumference of the metal pipe 22. Such absence of heating in the fixing nip N results in the temperature of a recording sheet S gradually decreasing as it passes through the fixing nip N, so that toner particles carried on the recording sheet S become colder, and therefore less viscous, at the exit of the fixing nip N.

Reduced viscosity of the toner image means a reduced adhesion of the toner image to the fuser belt 21 as the recording sheet S exits the fixing nip N. This results in good stripping of the printed recording sheet S from the fuser belt 21 at the exit of the fixing nip N, which prevents failures of the fixing device 20, such as jams at the fixing nip N due to recording sheets wrapping around the fuser belt, or contamination of the fuser belt with toner migrating from the printed face of the recording sheet.

The shape retention stay 28 comprises a mechanical stay of suitable shape that conforms to the turned longitudinal edges of the metal pipe 22 forming the side slot. The shape retention stay 28 is press-fitted to the side slot of the metal pipe 22 from within the roller interior to clamp together the turned longitudinal edges of the metal pipe 22. The shape retention stay 28 serves to retain the generally cylindrical shape of the metal pipe 22, and in particular, prevents the thin-walled roller 22 (e.g., a 0.1 mm-thick stainless steel roller in the present embodiment) from deforming due to elastic recovery of the roller material, a property known in the art as "springback".

Springback occurs where the rolled metal sheet tends to recover its original flat shape after bending, which causes the open-sided heat pipe to lose its generally cylindrical shape with the gap between the opening edges wider than that intended. If not corrected, deformation of the metal pipe can cause various defects due to interference or mis-coordination between the fuser belt and the metal pipe, such as the belt getting damaged or making noise by excessively rubbing against the metal pipe, or running out of track by slipping off the roller surface.

The shape retention stay 28 clamping together the opening edges of the metal pipe 22 effectively prevents the rolled metal sheet from springback. Such protection against roller deformation provided by the shape retention stay 28 ensures reliable operation of the fixing device 20 using the thin-walled metal pipe 22.

Figure 5:
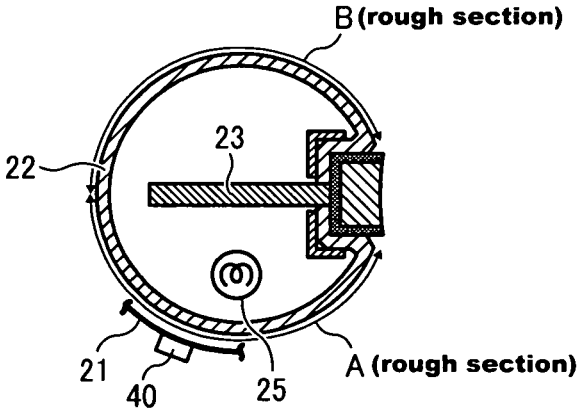
FIG. 5 is an end-on, axial cutaway view schematically illustrating one embodiment of a metal pipe employed in the fixing device according to this patent specification.

FIG. 5 is an end-on, axial cutaway view schematically illustrating the metal pipe 22 used in the fixing device 20 according to this patent specification.

As shown in FIG. 5, the surface of the metal pipe 22 has a rough section A defined along part or all of its outer circumference facing the inner surface 21*a* of the fuser belt 21. The rough section A exhibits a surface roughness equal to or greater than a particle size of the lubricant L (i.e., the size of particles or grains constituting the lubricant L) provided between the metal pipe 22 and the fuser belt 21. Such rough section A may be obtained by roughening the pipe surface through suitable surface treatment, such as etching or sand-blasting, during manufacture of the metal pipe 22.

For example, the rough section A may exhibit a surface roughness equal to or greater than approximately 2 μm, and preferably, in the range of approximately 2 μm to approximately 5 μm, where the lubricant L in use is of a particle size of approximately 2 μm. Setting the surface roughness of the metal pipe 22 within a moderate range is preferable, since a metal pipe with too great a surface roughness tends to severely abrade the inner surface of a fuser belt during operation, which would result in accelerated wear of the fuser assembly using the roughened metal pipe.

During operation, the rough section A allows the metal pipe 22 to retain the lubricant L along its outer circumference, wherein the lubricant particles, which are generally smaller than the pits and bumps of the rough section A, remain trapped between the irregularities and do not flow away when the fuser belt 21 slides over the surface of the metal pipe 22. Such arrangement maintains a proper amount of lubricant consistently present between the fuser belt 21 and the metal pipe 22, which prevents excessive frictional resistance at the belt/pipe interface due to displacement of lubricant over an extended period of use.

Preferably, the rough section A forms only part of the circumferential surface of the metal pipe 22. That is, the surface of the metal pipe 22 may also have an untreated, smooth section B, different from the rough section A, defined on its outer circumference. The smooth section B exhibits a surface roughness smaller than the particle size of the lubricant L. Such smooth section B may be obtained where the pipe circumference is not subjected to surface treatment for roughening during manufacture of the metal pipe 22.

Instead of providing the rough section A over the entire circumference of the metal pipe 22, forming the pipe surface partially of the rough section A and partially of the untreated smooth surface B results in reduced costs of the metal pipe 22 required to process the metal pipe through surface treatment during manufacture.

More preferably, the metal pipe 22 is installed with the rough section A positioned upstream and the smooth section B positioned downstream of the fixing nip N in the direction in which the fuser belt 21 moves along the pipe circumference (counterclockwise in the embodiment depicted in FIG. 5). Such arrangement ensures the metal pipe 22 remains lubricated sufficiently as needed during operation.

Specifically, around the metal pipe 22, the fuser belt 21 is subjected to higher tension upstream than downstream of the fixing nip N, so that the gap δ between the fuser belt 21 and the metal pipe 22 (which is on the order of 0.1 mm or smaller) is smaller upstream than downstream of the fixing nip N. Accordingly, the interface between the belt 21 and the pipe 22 upstream of the fixing nip N requires more stable provision of lubrication than is required downstream of the fixing nip N for secure operation of the fuser assembly. On the other hand, the belt/pipe interface downstream of the fixing nip N is less susceptible to abrasion and fatigue, and hence does not require as much lubrication to be maintained as that upstream of the fixing nip N.

With the rough section A positioned upstream of the fixing nip N, the metal pipe 22 can retain a stable amount of lubricant where it is most likely to come into sliding contact with the fuser belt 21, so as to reliably prevent the contacting surfaces from developing excessive frictional resistance. Moreover, as the fuser belt 22 travels past the fixing nip N along the pipe circumference, the lubricant L gradually flows from the smooth section B toward the rough section A to provide a continual supply of lubricant upstream of the fixing nip N after installation of the fuser assembly.

Hence, the fixing device 20 according to this patent specification can operate with extremely short warm-up time and first-print time required to process an initial print job at start-up, while maintaining proper lubrication at the interface of the fuser belt and the metal pipe owing to the metal pipe having its outer circumferential surface at least partially roughened to effectively retain the lubricant in position over an extended period of use.

Figure 6:
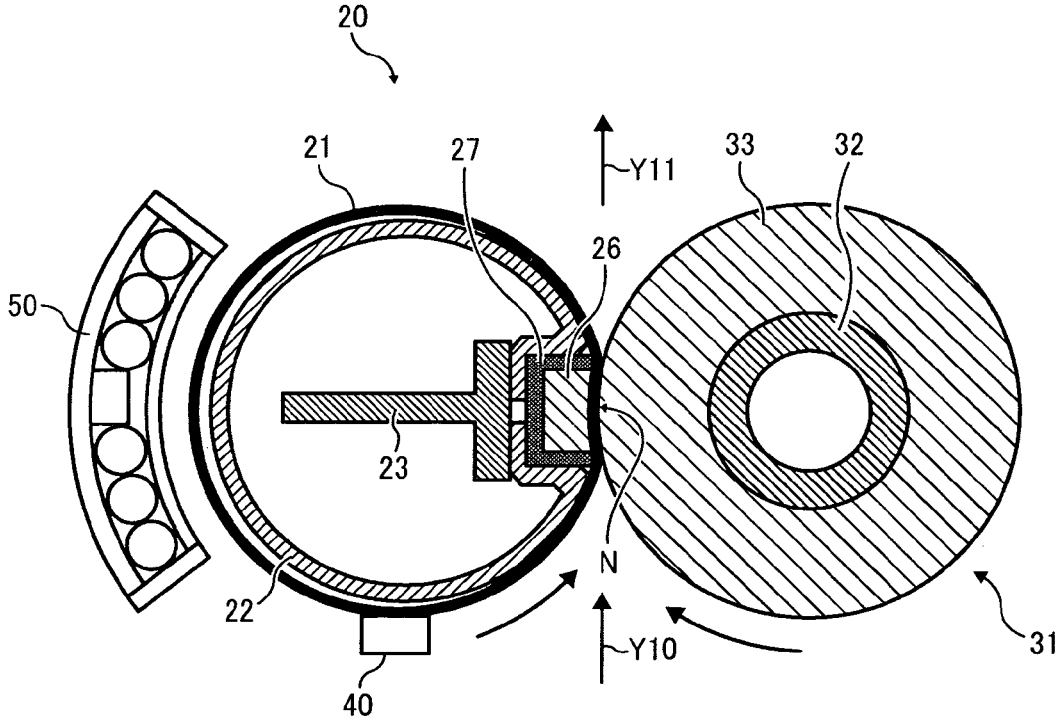
FIG. 6 is an end-on, axial cutaway view schematically illustrating another example of the fixing device incorporated in the image forming apparatus of FIG. 1.

FIG. 6 is an end-on, axial cutaway view schematically illustrating another embodiment of the fixing device 20 according to this patent specification, which employs an induction heater 50 that heats the circumference of the metal pipe 22 by electromagnetic induction, in place of the radiant heater 25 depicted in the embodiment of FIG. 2.

As shown in FIG. 6, the overall configuration of the fixing device 20 is similar to that depicted primarily with reference to FIG. 2, including the fuser pad 26 pressed against the pressure roller 31 via the fuser belt 21 to form the fixing nip N, the heat pipe 22 equipped with the heater 50 operated according to readings of the thermometer 40, and the heat insulating member 27 thermally insulating the fuser pad 26 from the metal pipe 22. Although not depicted in FIG. 6, the surface of the metal pipe 22 is at least partially formed of the rough section A to retain the lubricant L in position deposited between the fuser belt 21 and the metal pipe 22.

Specifically, the induction heater 50 consists of a set of electromagnetic coils or Litz wires each being a bundle of thinner wires extending across a portion of the fuser belt 21 in the axial direction and opposed to a semi-cylindrical main core formed of a ferromagnetic material with a high magnetic permeability ranging from approximately 1,000 to approximately 3,000, and optionally equipped with auxiliary central and/or side cores for efficient formation of magnetic flux, all of which are held by a coil support of suitable material such as heat resistant resin or the like.

During operation, the induction heater 50 generates an alternating magnetic field around the heat pipe 22 as a high-frequency alternating current passes through the electromagnetic coils. The changing magnetic field induces eddy currents over the surface of the heat pipe 22, which exhibits certain electrical resistivity to produce a corresponding amount of Joule heat from within. The heat pipe 22 thus heated through electromagnetic induction releases heat to the length of the fuser belt 21 rotating in the proximity of the pipe circumference, resulting in heating the fixing nip N to a desired processing temperature.

For maximizing heating efficiency through electromagnetic induction, preferably, the induction heater 50 extends along almost the entire circumference of the metal pipe 22 where it does not interfere with the mounting or operation of mechanisms surrounding the metal pipe 22. The heat pipe 22 is made of any suitable metal, including, but not limited to, nickel, stainless steel, iron, copper, cobalt, chromium, aluminum, gold, platinum, silver, tin, palladium, and alloys containing one or more of these metals.

Although the embodiments depicted above uses a radiant heater or an induction heater for heating the metal pipe 22, in further embodiments, such heating may be accomplished using a resistance heater attached to part or all of the inner circumference of the metal pipe 22. The resistance heater may include a substrate of electrically resistive heating element, such as a ceramic heater, disposed within the hollow interior of the metal pipe 22 with its opposed ends connected to a regulated power supply.

During operation, the resistance heater is supplied with a current from the power supply to generate an amount of heat proportional to the electrical resistance of the heating element for conduction to the inner circumference of the metal pipe 22. The metal pipe 22 thus heated through resistance heating releases heat to the length of the fuser belt 21 rotating in the proximity of the metal circumference, resulting in heating the fixing nip N to a desired processing temperature.

Further, although the embodiments described above employ a multi-layered fuser belt looped for rotation around the metal pipe 22, the fixing device according to this patent specification may be configured with a looped endless belt or film of any suitable material, such as polyimide, polyamide, fluorine resin, and metal, or combination of these materials.

Hence, the fixing device 20 according to this patent specification may be configured with various types of heaters and other fixing members depending on specific applications. In any such configuration, the fixing device 20 according to this patent specification can operate with extremely short warm-up time and first-print time required to process an initial print job at startup; while maintaining proper lubrication at the interface of the fuser belt and the metal pipe owing to the metal pipe having its outer circumferential surface at least partially roughened to effectively retain the lubricant in position over an extended period of use.

Numerous additional modifications and variations are possible in light of the above teachings. It is therefore to be understood that, within the scope of the appended claims, the disclosure of this patent specification may be practiced otherwise than as specifically described herein.

What is claimed is:

1. A fixing device comprising:

a tubular, stationary metal pipe subjected to heating;

a flexible fuser belt looped for rotation around the metal pipe to transfer heat radially outward from the heated metal pipe;

a rotatable pressure member extending opposite the metal pipe with the fuser belt interposed between the metal pipe and the pressure member;

a fuser pad held stationary inside the loop of the fuser belt to press against the pressure member through the fuser belt to form a fixing nip through which a recording medium is passed to fix a toner image thereupon under heat and pressure; and a lubricant of a given particle size deposited between the metal pipe and the fuser belt, wherein a surface of the metal pipe includes a rough section which exhibits a surface roughness equal to or greater than the particle size of the lubricant, and wherein the rough section exhibits a surface roughness in a range of approximately 2 μm to approximately 5 μm.

2. The fixing device according to claim 1, wherein the surface of the metal pipe has a smooth section, different from the rough section, which exhibits a surface roughness smaller than the particle size of the lubricant.

3. The fixing device according to claim 2, wherein the rough section and the smooth section are positioned upstream and downstream, respectively, of the fixing nip in a direction in which the fuser belt rotates around the metal pipe.

4. The fixing device according to claim 1, wherein the fuser pad is provided with a lubricant retained on an outer surface thereof facing the fuser belt.

5. The fixing device according to claim 1, wherein the fuser pad has a sheet of low-friction material impregnated with a lubricant to define an outer surface thereof facing the fuser belt.

6. The fixing device according to claim 1, further comprising:

a stationary reinforcing member extending from inside to outside the metal pipe to contact the fuser pad for reinforcement at the fixing nip, wherein the metal pipe faces the fuser belt except at the fixing nip with a longitudinal slot defined in one side thereof to accommodate the fuser pad in contact with the reinforcing member.

7. An image forming apparatus comprising:

an electrophotographic imaging unit to form a toner image on a recording medium; and a fixing device to fix the toner image in place on the recording medium, the fixing device including:

a tubular, stationary metal pipe subjected to heating;

a flexible fuser belt looped for rotation around the metal pipe to transfer heat radially outward from the heated metal pipe;

a rotatable pressure member extending opposite the metal pipe with the fuser belt interposed between the metal pipe and the pressure member;

a fuser pad held stationary inside the loop of the fuser belt to press against the pressure member through the fuser belt to form a fixing nip through which the recording medium is passed to fix a toner image thereupon under heat and pressure; and a lubricant of a given particle size deposited between the metal pipe and the fuser belt, wherein a surface of the metal pipe includes a rough section which exhibits a surface roughness equal to or greater than the particle size of the lubricant, and wherein the rough section exhibits a surface roughness in a range of approximately 2 μm to approximately 5 μm.

* * * * *